United States Patent [19]

Hayashida et al.

[11] Patent Number: 4,716,918

[45] Date of Patent: Jan. 5, 1988

[54] TENT

[75] Inventors: John P. Hayashida; Roger P. Bowman, both of Waterloo, Canada

[73] Assignee: Her Majesty the Queen in right of Canada, Canada

[21] Appl. No.: 876,397

[22] Filed: Jun. 20, 1986

[30] Foreign Application Priority Data

Feb. 10, 1986 [CA] Canada ..... 501510

[51] Int. Cl.[4] ..... E04H 15/14; E04H 15/36; E04H 15/56

[52] U.S. Cl. ..... 135/93; 135/102; 135/105; 135/116

[58] Field of Search ..... 135/102, 105, 101, 118, 135/116, 115, 91, 93

[56] References Cited

U.S. PATENT DOCUMENTS

| | | | |
|---|---|---|---|
| 2,299,078 | 10/1942 | Craig et al. | 135/91 X |
| 2,832,361 | 4/1958 | Smith | 135/118 X |
| 3,052,249 | 9/1962 | Seaman et al. | 135/118 X |
| 3,242,935 | 3/1966 | Williams | 135/118 X |
| 3,670,747 | 6/1972 | Pohl et al. | 135/105 X |
| 3,970,096 | 7/1976 | Nicolai | 135/104 X |
| 4,102,352 | 7/1978 | Kirkham | 135/93 X |
| 4,227,542 | 10/1980 | Bonfilio | 135/102 |
| 4,236,543 | 12/1980 | Moss | 135/105 |
| 4,404,980 | 9/1983 | Wade | 135/102 |
| 4,425,929 | 1/1984 | Von Mosshaim | 135/102 |
| 4,541,445 | 9/1985 | Ferguson | 135/105 X |
| 4,583,331 | 4/1986 | Hunt et al. | 135/102 |
| 4,597,402 | 7/1986 | Morris | 135/102 |

*Primary Examiner*—J. Karl Bell

*Attorney, Agent, or Firm*—Stevens, Davis, Miller & Mosher

[57] ABSTRACT

A tent comprises a shell including a floor and a canopy secured together. The floor and canopy are separably joined along a substantially U-shaped perimeter section to provide a door opening. The tent has a frame including an arch with its ends supported adjacent the ends of the door opening and extending across the tent to support the canopy above the floor. The arch is pivotable from a closed condition of the tent in which the floor and canopy meet along the U-shaped door opening and an open position in which the canopy is drawn up and away from the floor to permit access to the tent. The frame may also include two longitudinally oriented bowed supports supporting the canopy above the floor. The tent may, for cold weather use, include an insulating liner suspended from the frame and spaced from the canopy. The liner is preferably air pervious at a head end of the tent and impervious at a foot end of the tent. The canopy is then made with a breathing section at the head end. This may be accomplished by providing ventilating openings adjacent the top of the canopy at the head end of the tent and fresh air inlet openings adjacent the floor.

14 Claims, 11 Drawing Figures

TENT

FIELD OF THE INVENTION

The present invention relates to tents and more particularly to tents suitable for use as small survival shelters.

BACKGROUND

Numerous tent configurations have been proposed in a wide variety of configurations and sizes, predominantly for recreational uses. The known tents are not well suited to emergency use. A simple injury, say to one arm, may drastically increase the time required for pitching a conventional exit. For extreme cold conditions, commercial tents may require a supplementary heater or extra insulation such as an "arctic" sleeping bag.

The aim of the present invention is to provide a tent which is suitable for use as an emergency shelter. It is desired that embodiments of the invention are especially suited for cold weather use.

SUMMARY

According to one aspect of the present invention there is provided a tent comprising:

a shell including a floor and a canopy secured together, the floor and canopy being separably joined along substantially U-shaped perimeter sections thereof; and a frame comprising an arch having its ends supported adjacent the ends of the U-shaped perimeter section and supporting the canopy above the floor, the arch being pivotable from a closed condition of the tent in which the floor and canopy meet along their U-shaped perimeter sections and an open position in which the perimeter section of the canopy is drawn up and away from the perimeter section of the floor to permit access to the tent.

A tent of this type is easy to open, enter and close, even for injured persons with limited manoeverability and manual capability.

In preferred embodiments, the tent is made free standing through the use of two internal bowed supports that stretch the floor and support the canopy. These are easy to install and eliminate guylines and pegging of the floor.

According to another aspect of the present invention, there is provided a tent having an outer shell comprising a floor and a canopy joined together, and an insulating liner within the tent, spaced from the shell to provide an insulating air space therebetween.

A tent of this configuration is particularly suitable for Arctic use. The combination of insulating liner and air space around it retains body heat within the shelter, so that the user need not be confined to a sleeping bag.

In preferred embodiments, the tent and liner combination has a breathing section at the head end, providing for ventilation, and an air impervious section at the foot. Both the liner and the shell contribute to the breathing impervious characteristics. This prevents excessive moisture accumulation in the tent and provides fresh air to an occupant while returning the requisite insulating properties.

BRIEF DESCRIPTION OF THE DRAWINGS

In the accompanying drawings, which illustrate an exemplary embodiment of the present invention.

DETAILED DESCRIPTION

Figure 1:
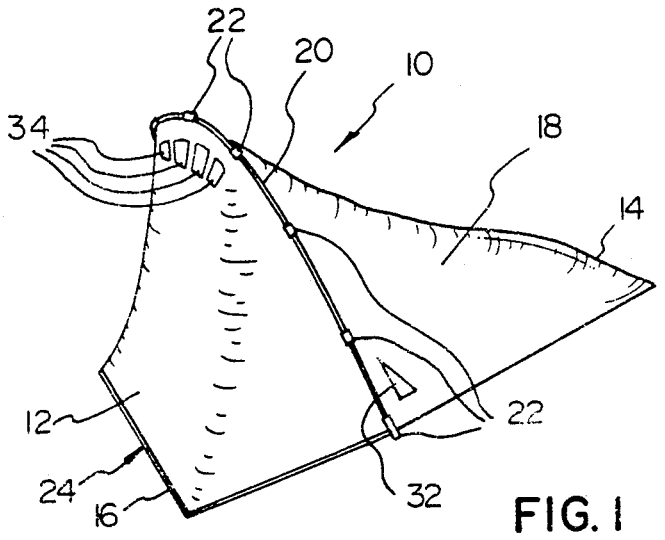
FIG. 1 is a perspective view of a tent.
Figure 2:
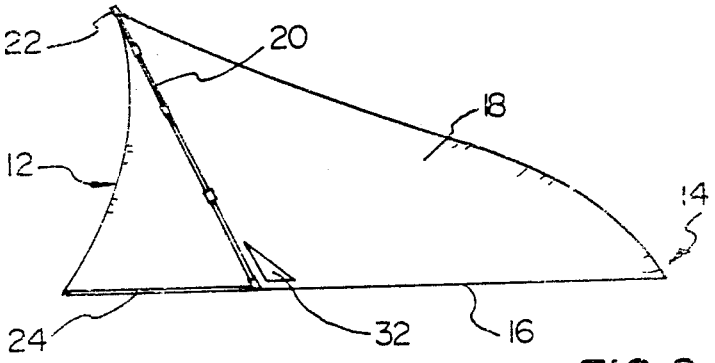
FIG. 2 is a side elevation of the tent of FIG. 1.
Figure 3:
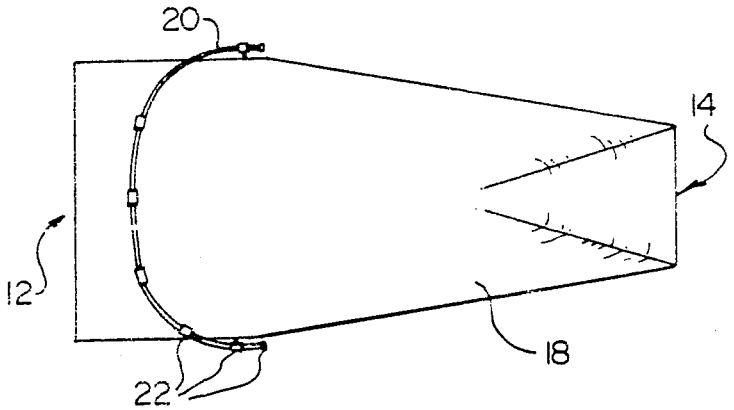
FIG. 3 is a plan view of the tent of FIG. 1.
Figure 4:
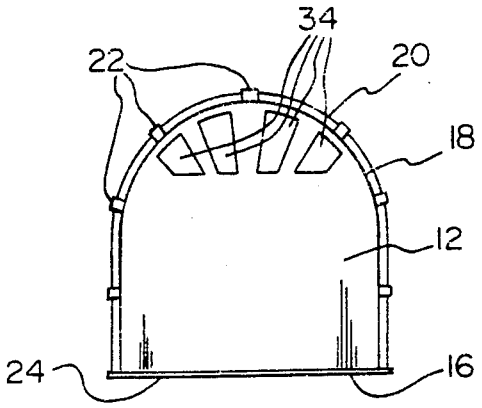
FIG. 4 is a front elevation of the tent.

Referring to the drawings, and in particular to FIGS. 1 through 4, there is illustrated a tent 10 that is elongate in form and tapers in height and width from a head end 12 to a foot end 14. The tent has a floor 12 and a canopy 18 that together cooperate to provide a completely enclosed shell. The canopy is supported adjacent the head end 12 by an arch support 20 that engages in a series of loops 22 spaced up the sides and over the top of the canopy. The arch slopes upwardly from the ground towards the head end of the tent when the tent is closed as shown in FIGS. 1 to 4.

Figure 5:
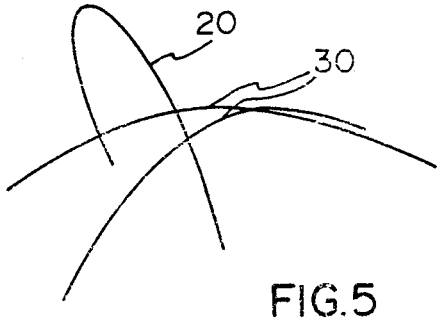
FIG. 5 is a perspective view of the pole structure for the tent.

The tent 10 has a door opening 24 between a U shaped section 26 of the floor perimeter and the adjacent U-shaped perimeter section 28 of the canopy around the head end of the tent. To retain the tent floor in a stretched condition, and to support the foot end of the canopy, two internal bowed supports 30 extend from respective foot end corners of the tent, where they are seated, across the tent and to the respective head end corners on the opposite sides of the tent. This is most particularly illustrated in FIG. 5, where the arch 20 and the two bowed supports 30 are illustrated without the tent. The arch 20 and the supports 30 are resilient so that the floor and canopy are stretched taut and the shell when erected is a free standing unit.

The canopy has air inlet openings 32 adjacent the floor on the side, just towards to the foot end from the arch 20 and air outlet openings 34 at the top, on the head end.

Figure 6:
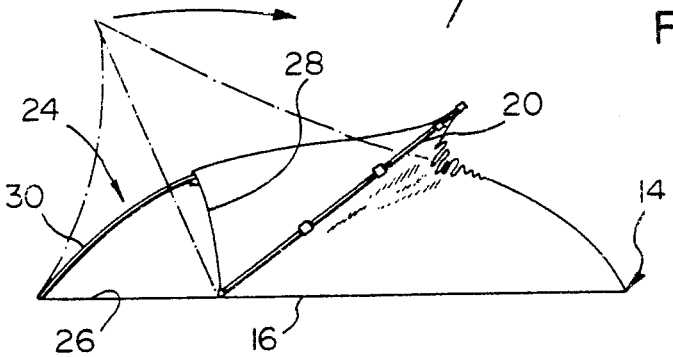
FIG. 6 is a side elevation of the tent showing the door in open condition.
Figure 7:
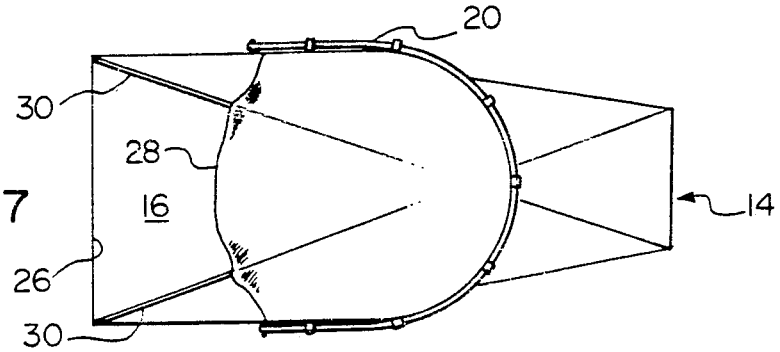
FIG. 7 is a plan view of the tent as shown in FIG. 6.

To set up the tent, the shell is laid out generally flat and the arch 20 is installed in the loops 22. The arch is sectional, so that this is a simple procedure. The arch is then pivoted towards the foot end, as illustrated in FIG. 6, and the bowed supports 30 are installed inside the tent. Like the arch, these supports are sectional so as to be readily portable. Where desired, the occupant can enter the tent and install the bowed supports 30 from the inside. The floor perimeter section 26 of the floor 16 and the canopy perimeter section 28 are joined by a slide fastener which serves to seal the door opening 24 closed.

The overall wedge shape of the tent has a number of benefits. The tent can be oriented with the foot end 14 facing into a prevailing wind to minimize wind effects on the tent. The tent occupant can lie down in the tent or sit up at the head end. Access to the tent is especially easy since when the door is opened by swinging the arch 20 towards the foot end of the tent as shown in FIG. 6, there is a large open space of floor 16 exposed. The occupant simply sits on this exposed floor and pulls the canopy back to a closed position. It will be understood that this is a very simple operation, even for an injured individual. The internal bowed supports and external arch provide a frame for the tent that is entirely ground independent. That means that the tent is free standing and independent of terrain.

Figure 8:
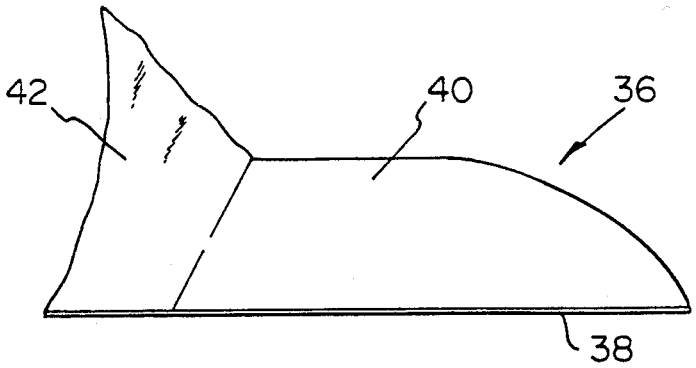
FIG. 8 is a side elevation of a tent liner.
Figure 9:
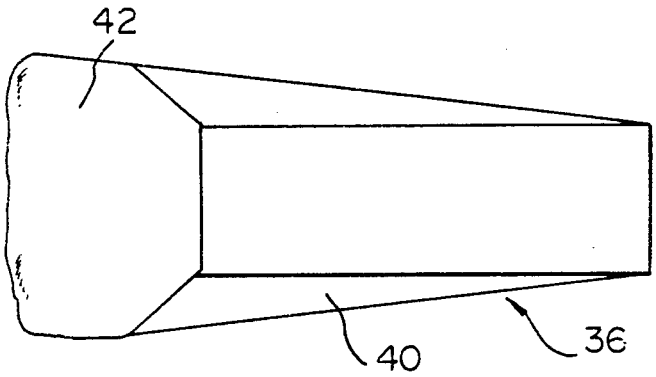
FIG. 9 is a plan view of the liner of FIG. 8.
Figure 11:
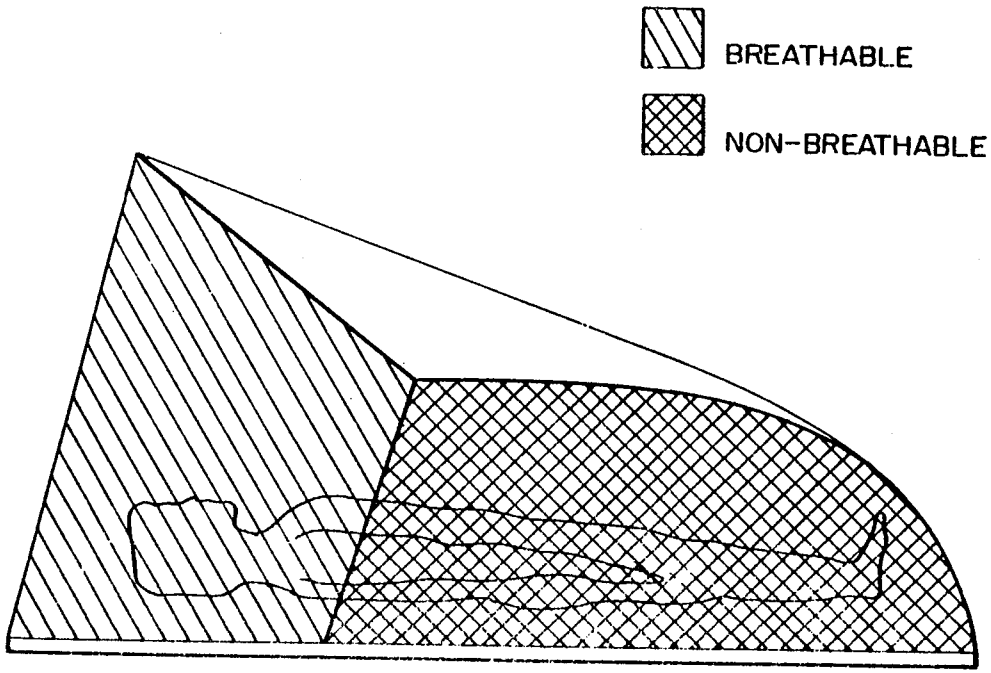
FIG. 11 is a schematic view showing breathable and non breathable zones of the tent liner.

FIGS. 8, to 11 illustrate a tent liner 36 that can be installed in the tent of FIGS. 1 through 7 to equip it for Arctic use. The liner has an insulating floor 38 made from a "Therm-a-Rest" (TM) mat. manufactured by Cascade Designs Inc. The mat consists of a layer of open cell foam sandwiched between two layers of urethane coated nylon. The two nylon sheets form an airtight seal around the mat. A valve is used to allow air in and out of foam core. When the mat is to be used, the valve is opened allowing air to enter on its own as the foam expands. Once full expansion has been reached, the valve is closed. When the mat is not in use, the air may be squeezed out and the valve shut to reduce the volume of the mat. Similar material is used for the remainder of the liner foot section 40 so that this portion of the liner is fully self supporting. The foot section is slightly smaller in dimensions than the foot section of the canopy so that there is an insulating air gap between the two. The head section 42 of the liner 36 is made of an air pervious material or combination of materials so that it can breath and provide proper ventilation of the head end of the tent, thus preventing moisture buildup and ensuring that the tent is adequately supplied with breathable air. A suitable material for this section of the liner is a combination of synthetic fibers and reflective insulating materials such as is found in some brands of Arctic sleeping bags.

Figure 10:
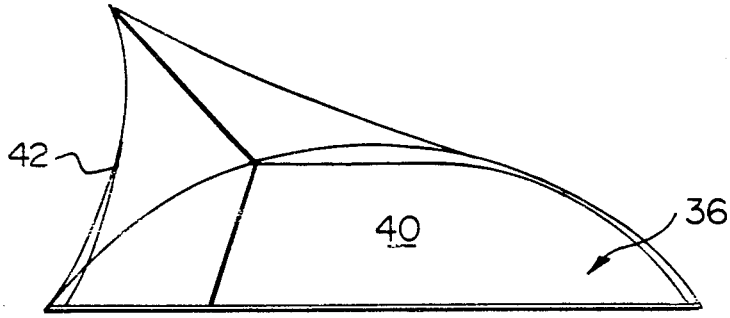
FIG. 10 is a side elevation, partially broken away of the combined tent and liner.

The breathable head section of the liner is suspended from the main arch of the canopy as shown most particularly in FIG. 10. As seen in that Figure, the combination of the tent and the liner provides a chamber between the canopy and the liner. This chamber is ventilated by air entering vents 32 and exhausting through outlets 34. The rate of ventilation is controlled to control the rate of heat loss from within the liner.

FIG. 11 illustrates in a schematic way the breathable and non-breathable sections of the tent, and how those sections are located with respect to the body of a recumbent occupant.

While specific embodiments of the invention have been described in the foregoing, it is to be understood that others are possible within the scope of the invention. For example, the configuration of the canopy as a wedge may be modified. The three support pole structure may be reduced to the arch only where it is acceptable for foot end of the canopy section to collapse when the tent is open. The inflatable mats used for the liner foot section can be replaced with other suitable structures. Where descried the mats may be inflated orally, with a manual pump or with a compressed gas cartridge.

We claim:

1. A tent comprising:

a shell including a floor and a canopy secured together, the floor and canopy being separably joined along substantially U-shaped perimeter sections thereof and;

a frame comprising an arch extending laterally of the tent and having its ends supported adjacent the ends of the U-shaped perimeter sections and supporting the canopy above the floor, and two longitudinally oriented bowed supports supporting the canopy above the floor, the arch being pivotable from a closed condition of the tent in which the floor and canopy meet along their U-shaped perimeter sections and an open position in which the perimeter section of the canopy is drawn up and away from the perimeter section of the floor to permit access to the tent.

2. A tent according to claim 1, wherein the arch is located externally of the canopy.

3. A tent according to claim 2, wherein the bowed supports are inside the canopy.

4. A tent according to claim 1, including a liner of thermally insulating material suspended from the frame and space from the canopy.

5. A tent according to claim 1, wherein the U-shaped perimeter sections of the floor and canopy and the arch are located at a head end of the tent.

6. A tent according to claim 4, wherein the liner is air pervious at a head end of the tent and impervious at a foot end of the tent.

7. A tent according to claim 6, wherein the canopy has a breathing section at the head end of the tent.

8. A tent according to claim 7, including ventilating openings adjacent the top of the canopy at the head end of the tent and fresh air inlet openings adjacent the floor.

9. A tent according to claim 5, wherein the tent tapers in height and width from the head end of the tent to the foot end.

10. A tent according to claim 6, wherein the impervious section of the liner is self supporting.

11. A tent having an outer shell comprising a floor and a canopy joined together, and a liner of thermally insulating materials within the tent, spaced from the shell to provide an insulating air space therebetween, the liner being air pervious at a head end of the tent and impervious at a foot end of the tent.

12. A tent according to claim 11, wherein the canopy has a breathing section at the head end of the tent.

13. A tent according to claim 12, including ventilating openings adjacent the top of the canopy at the head end of the tent and fresh air inlet openings adjacent the floor.

14. A tent according to claim 11, wherein the impervious section of the liner is self supporting.

* * * * *